United States Patent [19]

Campbell

[11] Patent Number: 4,678,192

[45] Date of Patent: Jul. 7, 1987

[54] MANUALLY ASSEMBLED PUZZLE APPARATUS

[76] Inventor: Bruce E. Campbell, P.O. Box 118, Smithfield, Va. 23430

[21] Appl. No.: 815,541

[22] Filed: Jan. 2, 1986

[51] Int. Cl.[4] ..... A63F 9/12; A63H 33/08

[52] U.S. Cl. ..... 273/157 R; 446/97; 446/124

[58] Field of Search ..... 273/156, 157 R; 446/97, 446/101, 120, 121, 124

[56] References Cited

U.S. PATENT DOCUMENTS 2,939,243 6/1960 Duggar ..... 273/157 R X
3,523,384 8/1970 Adelsohn ..... 446/97 X

FOREIGN PATENT DOCUMENTS 96335 6/1963 Denmark ..... 273/157 R
960965 6/1964 United Kingdom ..... 446/97

*Primary Examiner*—Anton O. Oechsle
*Attorney, Agent, or Firm*—Sandler & Greenblum

[57] ABSTRACT

The invention concerns a parallelepipedic puzzle, its parts, and method of assembly. The puzzle is formed from a group of smaller parallelepipeds each of which are biorientationally attached to the others using a series of pegs and holes affixed on diagonals of the faces of the smaller parallelepipeds. The cube has external aesthetic parts attached at positions on faces of the smaller cubes to signify the solution orientation which is achieved when the external parts are attached in their normal anatomical positions and no extra apertures remain on any exposed surfaces.

33 Claims, 15 Drawing Figures

FIG. 1
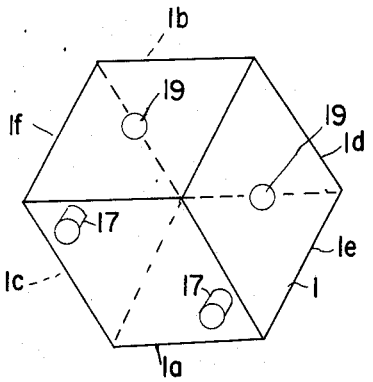
FIG. 2.
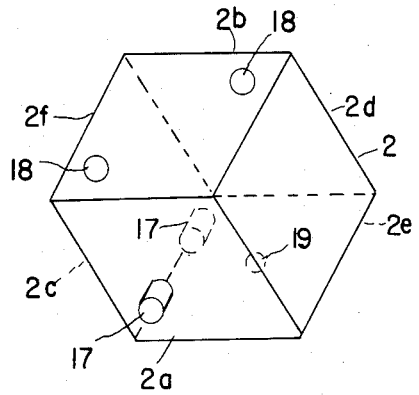
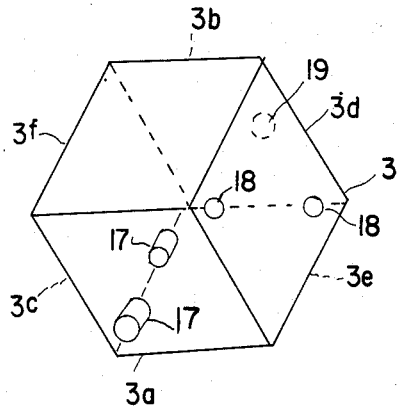
FIG. 3.
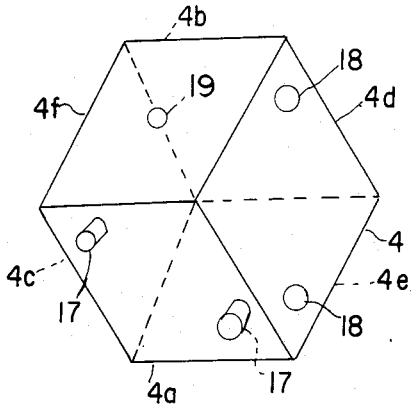
FIG. 4.

FIG. 5.
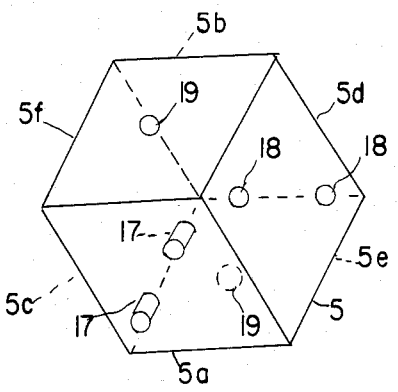
FIG. 6.
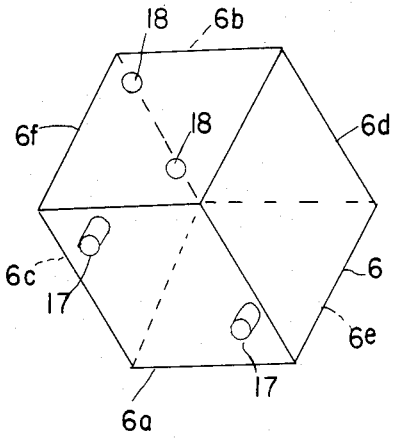
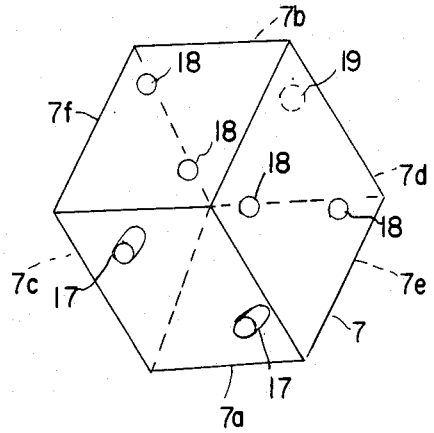
FIG. 7.
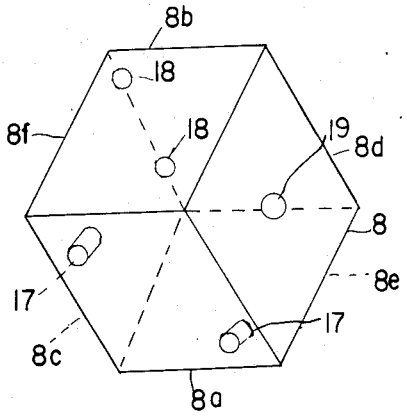
FIG. 8.

MANUALLY ASSEMBLED PUZZLE APPARATUS

BACKGROUND OF THE INVENTION

1. Field of the Invention

The present invention generally relates to a puzzle, its pieces and the method of solution therefore.

2. Discussion of Background Information

There presently exist certain puzzle-type games, e.g. Rubik's Cube (TM), in which one cubic piece is composed of a number of smaller cubic pieces. The small cubic pieces often have faces of different colors so that, through a series of rotations of the smaller pieces, the larger cubic can be oriented so as to have monochromatic sides. Other such puzzle-type games are made up of small cubes, some of which are permanently fixed in unique parts. These parts are disassembled, and then reassembled in a particular fashion to reform the cube. Usually in this second group of games, the cube can only be formed in one combination of the parts.

The present invention is akin to both types of games, in that a parallelepiped can be disassembled into a number of pieces, and in that the orientation of the particular faces is crucial to the solution, as in the former. One of the unique aspects of the present invention is that the puzzle can itself be formed in a multiple number of ways, but only one orientation of the outer faces permits attachment of the legs, nose and mouth and achievement of the solution orientation of the character. This particular puzzle design provides another distinction from the prior art by providing for a relatively large number of dead ends in the puzzle. Meaning that the attachment for the blocks and the apertures for receiving the dowels of the character parts (legs, nose, and mouth) are less valuable as indicators of progress toward the solution, since any two blocks can be attached together in at least two ways, and extra apertures are included which are capable of receiving the dowel of the legs, nose and mouth, that in the solution orientation are positioned on one of the unexposed faces of one of the blocks.

This invention has a number of uses beyond that of a pleasant pastime. The puzzle can be utilized to instruct children in better hand-eye coordination, or to help victims of neurological disorders in re-education of their muscles and the development of motor skills. Since the solution is manually as well as visually perceivable, this puzzle can be used by the blind as well as the sighted. Finally, as with all of the puzzles mentioned, this invention can be used to sharpen analytical skills.

SUMMARY OF THE INVENTION

This invention relates to a puzzle, its pieces, and the method of solution therefor. The puzzle is formed from a set of at least eight parallelepipedic blocks adapted to be assembled into a parallelepiped. Each of the blocks has a top face, a bottom face, first and second opposite side faces, and first and second opposite end faces. A first block has at least one peg on its top face, a planar bottom face, a planar first side face, a second side face with at least one aperture, a planar first end face, and a second end face having at least one aperture. A second block has at least one peg on its top face, a planar bottom face, planar first and second side faces, a first end face having at least one aperture, and a second end face having at least one hole. A third block has at least one peg on its top face, at least one aperture on its bottom face, a planar first side face, a second side face having at least one hole, and a planar first and second end faces. A fourth block has at least one peg on its top face, a planar bottom face, a planar first side face, a second side face having at least one hole, a planar first end face, and a second end face with at least one aperture. A fifth block has at least one peg on its top face, a planar bottom face, a planar first side face, a second side face having at least one hole, and at least one aperture in each of the first and second end faces. A sixth block has at least one peg on its top face, a planar bottom face, planar first and second side faces, a planar first end face, and a second end face having at least one hole. A seventh block having at least one peg on its top face, at least one aperture on its bottom face, a planar first side face, a second side face having at least one hole, a planar first end face, and a second end face having at least one hole. An eighth block has at least one peg on its top face, a planar bottom face, a planar first side face, a second side face with at least one aperture, a planar first end face, and a second end face having at least one hole.

In a preferred configuration, the invention also includes four legs, a nose, and a mouth, each having a generally cylindrical dowel which is adapted to be inserted into one of the apertures attached to the outside of the cube when formed. In a preferred configuration, the blocks are configured as follows: The first block has two spaced pegs on its top face, an aperture on its second side face, and an aperture on its second end face; each aperture include means for frictionally receiving one of the dowels. The second block has two spaced pegs on its top face, an aperture on its first end face for frictionally receiving one of the dowels, and two holes on its the second end face, each for frictionally receiving one of the pegs of another block. The third block has two spaced pegs on its top face, an aperture for frictionally receiving one of the dowels on its bottom face, and two holes on its second side face, each for frictionally receiving one of the pegs of another block. The fourth block has two spaced pegs on its top face, two holes on its second side face, each for frictionally receiving one of the pegs of another block, and an aperture for frictionally receiving one of the dowels on its second end face. The fifth block has two spaced pegs on its top face, two holes on its second side face, each for frictionally receiving one of the pegs of another block, and apertures on its first and second end faces, each for frictionally receiving one of the dowels. The sixth block has two spaced pegs on its top face and two holes on its second end face, each for frictionally receiving one of the pegs of another block. The seventh block has two spaced pegs on its top face, an aperture on its bottom face for frictionally receiving one of the dowels, two holes on its second side face, each for frictionally receiving one of the pegs of another block, and two holes on its second end face, each for frictionally receiving one of the pegs from another block. The eighth block includes two spaced pegs on its top face, an aperture on its second side face for frictionally receiving one of the dowels, and two holes on its second end face, each for frictionally receiving one of the pegs of another block.

In a preferred configuration the holes have a larger diameter than the apertures and the parrallelepipedic blocks are cubic.

A second integral part of the invention goes to the method of assembling a parallelepiped from at least eight smaller parallelepipedic blocks. The method includes:

(a) attaching a first block to a fifth block by inserting two pegs on a first face of the first block into two holes on a first face of the fifth block;

(b) attaching the fifth block to a seventh block by inserting two pegs on a second face of the fifth block into two holes on a first face of the seventh block;

(c) attaching the seventh block to a third block by inserting two pegs on a second face of the seventh block into two holes on a first face of the third block;

(d) attaching an eighth block to a sixth block by inserting two pegs on a first face of the sixth block into two holes on a first face of the eighth block;

(e) attaching the sixth block to a second block by inserting two pegs on a first face of the second block into two holes on a second face of the sixth block;

(f) attaching the second block to a fourth block by inserting two pegs on a first face of the fourth block into two holes on a second face of the second block;

(g) attaching the third block to the fourth block by inserting two pegs on a second face of the third block into two holes on a second face of the fourth block; and (h) attaching the seventh block to the eighth block by inserting two pegs on a second face of the eighth block into two holes on a third face of the seventh block.

This method forms a parallelepiped in an orientation so that each of the external faces of each of the blocks is in a unique position. The invention further provides an indicator of the solution orientation through attaching generally cylindrical dowels to apertures in the first, second, third, fifth, seventh, and eighth blocks; by inserting a first leg dowel into an aperture in a second face of first block, inserting a second leg dowel into an aperture on a third face of the second block, inserting a third leg dowel into an aperture on a fourth face of the seventh block, inserting a fourth leg dowel into an aperture on a third face of the eighth block, inserting a nose dowel into an aperture on a third face of the third block, and inserting a mouth dowel into an aperture on a third face of the fifth block.

Finally the invention encompasses the parallelepipedic puzzle as formed from at least eight smaller parallelepipedic blocks, the puzzle including at least first, second, third, fourth, fifth, sixth, seventh, and eighth blocks, each block having first, second, third, fourth, fifth, and sixth faces, wherein the first and fifth blocks, fifth and seventh blocks, seventh and third blocks, fourth and second blocks, second and sixth blocks, sixth and eighth blocks, third and fourth blocks, and seventh and eighth blocks, respectively, have faces which are directly connected to each other, all of the remaining faces being physically unattached to each other.

In a preferred configuration, each of the blocks has three faces exposed to the exterior of the puzzle when formed. Further, the three exposed faces of the fourth block and sixth block are flat and have no apertures, holes or pegs thereon. The first and second blocks have adjacent exposed faces with an aperture on each, and are positioned on a first side of the puzzle. The seventh and eighth blocks have adjacent exposed faces with an aperture on each, and positioned on the second side of the puzzle. The third and fifth blocks have exposed faces with an aperture on each, diagonally arranged on a third side of the puzzle.

The completed puzzle includes four legs, a nose, and a mouth, each of them including a generally cylindrical dowel. The legs are inserted into the exposed apertures of the first, second, seventh, and eighth blocks. The mouth is inserted into the exposed aperture of the fifth block, and the nose is inserted into the exposed aperture of the third block. When formed and supported by the legs, the body has a generally diamond shaped cross section. There is only one solution which we will permit the attachment of the dowels to support the body in this way, and form the character with no extra holes, or apertures or pegs showing.

The puzzle more particularly includes at least one peg on one face of each of the blocks and at least one hole for frictionally receiving that peg on at least one of the other blocks for forming the direct connections between the blocks. To specify further, the means of direct connection include two pegs on at least one face of each block and at least two holes for frictionally receiving the pegs on at least one face of at least one other block, and in a preferred configuration the diameters in the holes are larger than the respectively diameters of the apertures.

Each block in the puzzle has a top face, bottom face, first and second opposed side faces, and first and second opposed end faces. The puzzle is formed from at least eight blocks with the following orientations of pegs, holes, and apertures. The first block has two spaced pegs on its top face, an aperture on its second side face, and an aperture on its second end face, each aperture include means for frictionally receiving one of the dowels. The second block has two spaced pegs on its top face, an aperture on its first end face for frictionally receiving one of the dowels, and two holes on its the second end face, each for frictionally receiving one of the pegs of another block. The third block has two spaced pegs on its top face, an aperture for frictionaly receiving one of the dowels on its bottom face, and two holes on its second side face, each for frictionally receiving one of the pegs of another block. The fourth block has two spaced pegs on its top face, two holes on its second side face, each for frictionally receiving one of the pegs of another block, and an aperture for frictionally receiving one of the dowels on its second end face. The fifth block has two spaced pegs on its top face, two holes on its second side face, each for frictionally receiving one of the pegs of another block, and apertures on its first and second end faces each for frictionally receiving one of the dowels. The sixth block has two spaced pegs on its top face and two holes on its second end face, each for frictionally receiving one of the pegs of another block. The seventh block has two spaced pegs on its top face, an aperture on its bottom face for frictionally receiving one of the dowels, two holes on its second side face, each for frictionally receiving one of the pegs of another block, and two holes on its second end face each for frictionally receiving one of the pegs from another block. The eighth block includes two spaced pegs on its top face, an aperture on its second side face for frictionally receiving one of the dowels, and two holes on its second end face, each for frictionally receiving one of the pegs of another block.

BRIEF DESCRIPTION OF THE DRAWINGS

Other features and advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

FIG. 1–8 are perspective views of blocks 1–8, respectively;

DETAILED DESCRIPTION AND PREFERRED EMBODIMENTS

Figure 9:
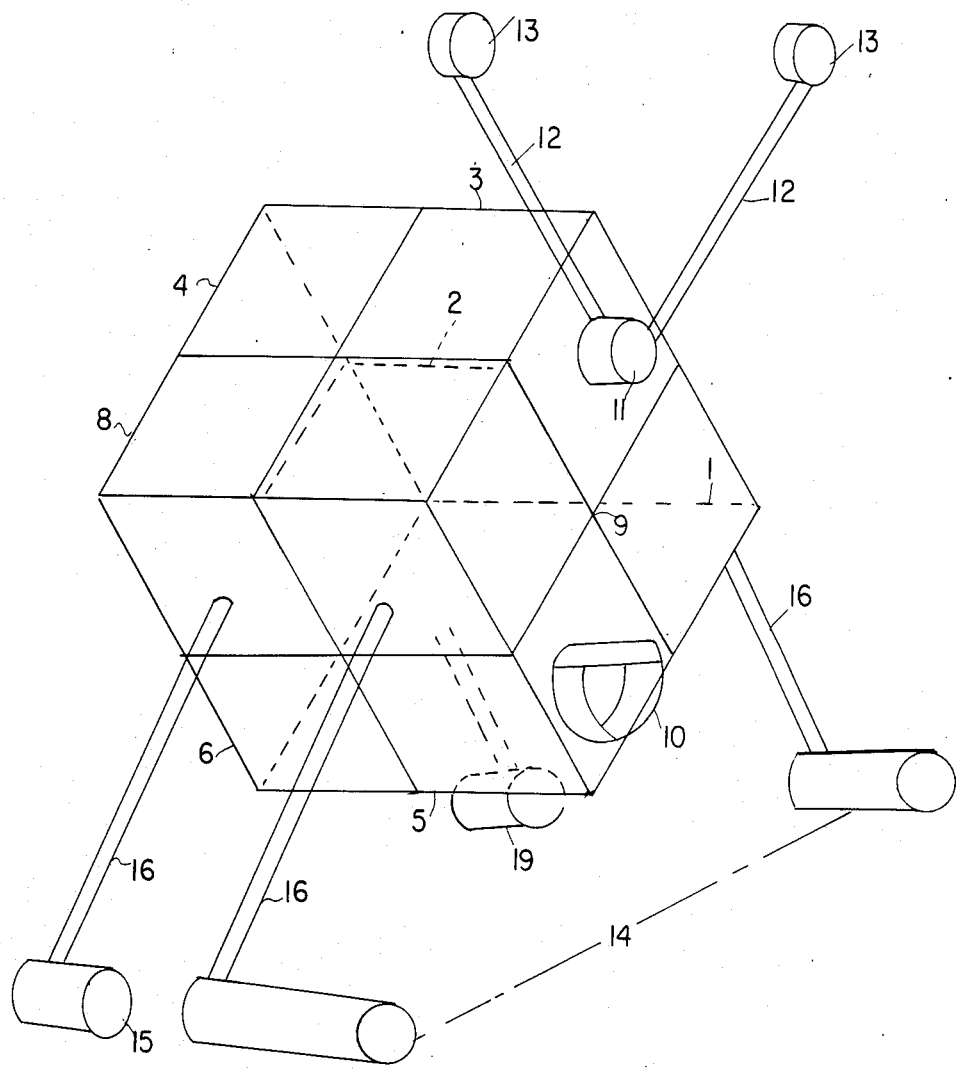
FIG. 9 is a perspective view of the assembled puzzle having the appendages attached in the orientation of the correct solution.

FIGS. 1–8 show the pegs 17, holes 18, and apertures 19 as arranged on each of the individual blocks 1–8. For illustration clarity, the faces of the blocks have been labeled a–f in the drawings and are identified using those labels in this section, but the inventor does not intend his invention to be restricted to the orientation shown in the figures. Each block has one pair of pegs 17 mounted diagonally on one face; the spacing and positioning of which are the same on corresponding faces on each of the blocks. Each block except block 1, also has a pair of holes 18 spaced on the diagonal of a face which are capable of receiving pegs 17 of another block. Each block, except block 6, also has at least one aperture 19 positioned in the center of a face which can receive a mouth or nose dowel 20 or a leg dowel 16. Some of these holes face inwardly and are not used to attach external members in the solution orientation. Their function is to misdirect the assembler to an incorrect orientation and to permit only a single proper orientation as clearly illustrated in FIG. 9.

FIG. 1 shows block 1 with pegs 17 positioned diagonally on top face 1*a*, an aperture 19 on each of two other faces, i.e., second side face 1*d* and second end face 1*f*. Planar bottom face 1*b*, planar first side face 1*c* and planar first end face 1*e*. The aperture 19 on second end face 1*f* in FIG. 1 receives a leg dowel 16 with a front foot 14 attached at one end, the pegs 17 of block 1 rest in the holes 18 of block 5, and the other aperture 19 is unused and faces inward in the solution orientation.

FIG. 2 shows block 2 with pegs 17 positioned diagonally on top face 2*a*, holes 18 positioned diagonally on a second end face 2*f*, an aperture 19 on first end face 2*e*, planar bottom face 2*b*, and planar first and second side faces 2*c* and 2*d*. The pegs 17 of block 2 rest in the holes 18 of block 6; the holes 18 of block 2 receive the pegs 17 of block 4; and the aperture 19 receives a leg dowel 16 with a back foot 15 attached at one end in the solution orientation.

FIG. 3 shows block 3 with pegs 17 positioned diagonally on top face 3*a*, holes 18 positioned diagonally on second side face 3*d*, an aperture 19 on bottom face 3*b* planar first side face 3*c*, and planar first and second end faces 3*e* and 3*f*. The aperture 19 holds the dowel 20 of the nose 11, the pegs 17 of block 3 rest in the holes 18 of block 4, and the holes 18 of block 3 receive the pegs 17 of block 7 in the solution orientation.

FIG. 4 shows block 4 with pegs 17 positioned diagonally on top face 4*a*, holes 18 positioned diagonally on second side face 4*d*, an aperture 19 on second end face 4*f*, planar bottom face 4*b*, planar first side face 4*c*, and planar first end face 4*e*. The holes 18 of block 4 receive the pegs 17 of block 3; and the pegs 17 of block 4 rest in the holes 18 of block 2 in the solution orientation. Aperture 19 is unused and is left unattached, facing inward, in the solution orientation.

FIG. 5 shows block 5 with pegs 17 positioned diagonally on top face 5*a*, holes 18 positioned diagonally on second side face 5*d*, a first aperture 19 on first end face 5*e* (shown in dashes), a second aperture 19 on second end face 5*f*, planar bottom face 5*b*, and planar first side face 5*c*. The pegs 17 of block 5 rest in the holes 18 of block 7, the holes 18 of block 5 receive the pegs 17 of block 1, the aperture 19 on first end face 5*e* (shown in dahes in FIG. 5) receives the dowel 20 of the mouth 10, and the other aperture 19 is unused facing inward in the solution orientation.

FIG. 6 shows block 6 with pegs 17 positioned diagonally on top face 6*a*, holes 18 positioned diagonally on second end face 6*f*, planar bottom face 6*b*, planar first and second side faces 6*c* and 6*d*, and planar first end face 6*e*. The holes 18 of block 6 receive the pegs 17 of block 2, and the pegs 17 of block 6 rest in the holes 18 of block 8 in the solution orientation.

FIG. 7 shows block 7 with pegs 17 positioned diagonally on top face 7*a*, holes 18 positioned diagonally on second side face 7*d* and second end face 7*f*, an aperture 19 on bottom face 7*b*, planar first side face 7*c*, and planar first end face 7*e*. The pegs 17 of block 7 rest in the holes 18 of block 3, the holes 18 of block 7 on face 7*d* receive the pegs 17 of block 5, the holes 18 of block 7 on face 7*f* receive the pegs 17 of block 8, and the aperture 19 of block 7 receives a leg dowel 16 with a front foot 14 attached at one end in the solution orientation.

FIG. 8 shows block 8 with pegs 17 positioned diagonally on top face 8*a*, holes 18 positioned diagonally on second end face 8*f*, an aperture 19 on second side face 8*d*, planar bottom face 8*b*, planar first side 8*c* and planar first end face 8*e*. The holes 18 of block 8 receive the pegs 17 of block 6, the pegs 17 of block 8 rest in the holes 18 of block 7 and the aperture 19 of block 8 receives a leg dowel 16 with a back foot 15 attached at one end in the solution orientation.

FIG. 9 shows the puzzle invention in the proper solution orientation. The main cubic body 9 is constructed from eight same sized cubes 1–8 (cube 2 and the fourth leg are shown in dashes). The primary function of the character parts (10, 11, 12, 13, 14, 15, 16) is to show orientation of the solution, but they are also designed to make the finished solution appealing to a child's eye. Front feet 14 are attached to two of the leg dowels 16 and back feet 15 are attached to two other leg dowels 16, and eyes 13 are attached to the nose 11 by stems 12. The stems 12 are of the same diameter as the leg dowels 16, but slightly longer, providing more confusion in assembling the puzzle. The dowels 20 on the backs of the mouth 10 and the nose 11 are the same diameter as the leg dowels 16, again increasing the number of possible incorrect orientations of the puzzle; insofar as, any of the dowels can be inserted into the apertures in all of the puzzle cubes.

Figure 11:
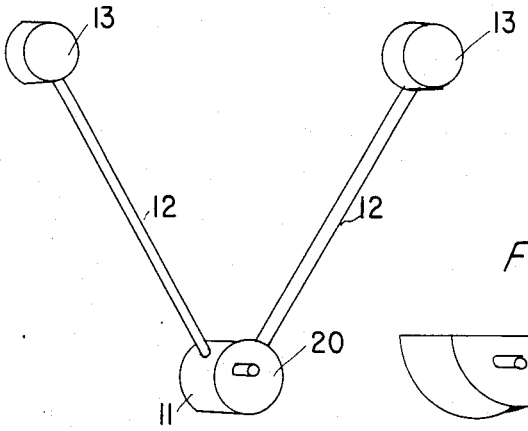
FIG. 11 is a perspective view of the nose and eyes unit.
Figure 10:
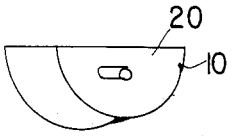
FIG. 10 is a perspective view of the mouth.
Figure 13:
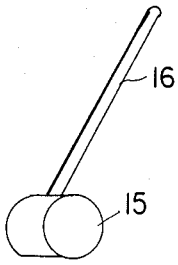
FIG. 13 is a perspective view of one back foot and leg.
Figure 12:
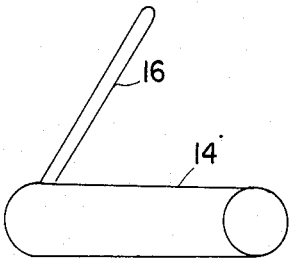
FIG. 12 is a perspective view of one front foot and leg.

FIG. 10 shows a backview of the mouth with a dowel 20, FIG. 11 shows the nose and eyes and FIGS. 12 and 13 show the front feet 14 and back feet 15, respectively, as attached to legs 16. The mouth, nose, and legs signify the single correct solution orientation of the puzzle by their normal anatomical position on the body. When the appendages are inserted into the exposed apertures on the blocks, there remain no free apertures on the exposed surfaces.

Figure 14A:
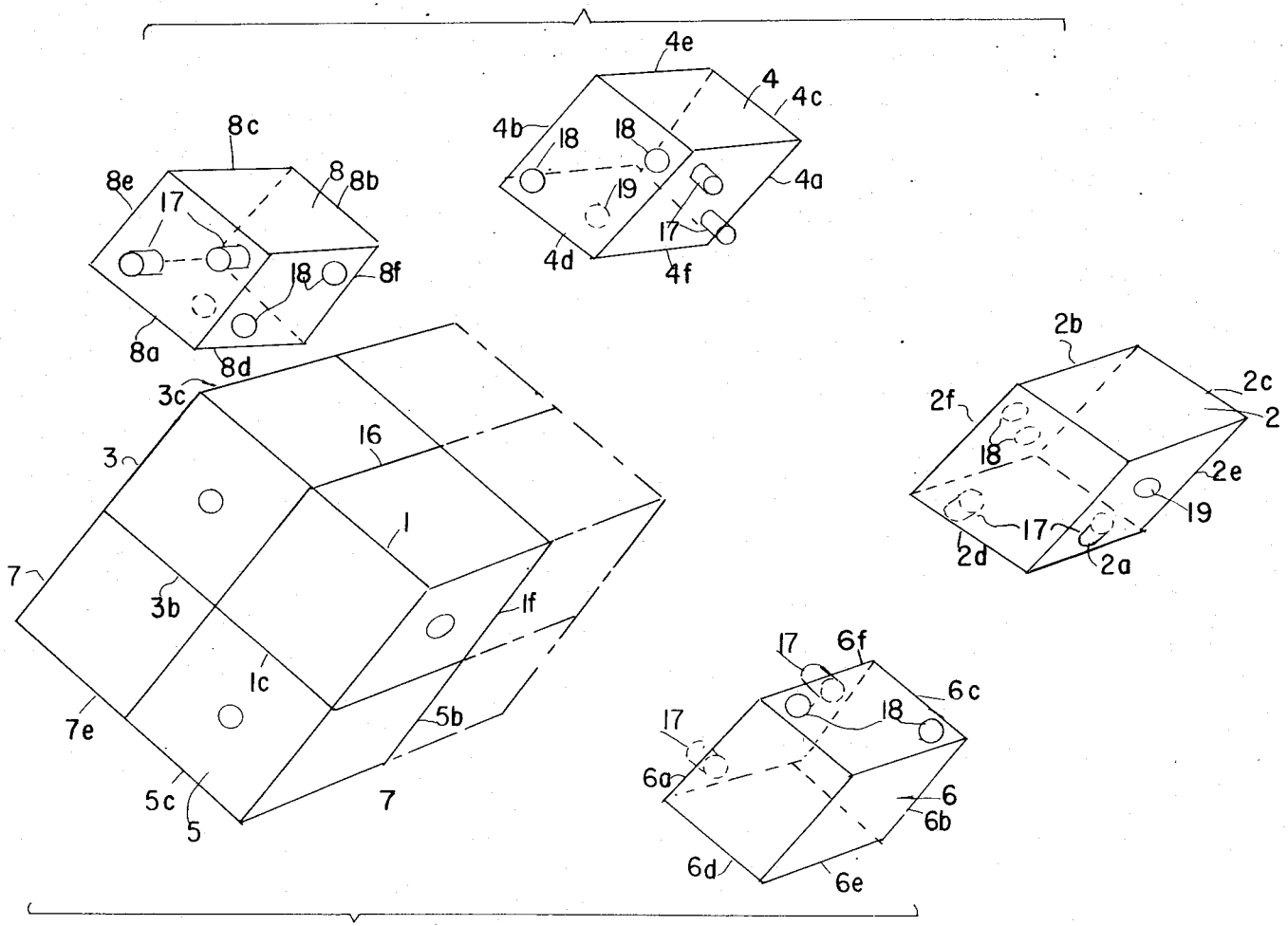
FIG. 14A is a partial, exploded, perspective view of the back half of the Puzzle body.

FIG. 14A shows the assembly of the back half of the puzzle (blocks 2, 4, 6 and 8) exploded in the background and the front half of the puzzle (blocks 1, 3, 5, and 7) in its solution orientation as in FIG. 9, but with the dowels removed.

The blocks 2, 4, 6 and 8 are shown, exploded from their respective solution orientations. Each has been translated to its position in the assembled cube while maintaining its orientation to illustrate the connection of the dowels and holes of each block in the half of the puzzle. The holes and dowels are shown as positioned on the respective faces of the respective blocks as shown in FIGS. 2, 4, 6, and 8, but here the blocks have been reoriented to their respective solution orientations. Note that the dashed lines on body 9 represent the position of the block 2, 4, 6 and 8 when the puzzle is assembled; block 8 cannot be shown on the body 9, and block 2 is shown in FIG. 14B its position more clearly than could be shown in FIG. 9.

Figure 14B:
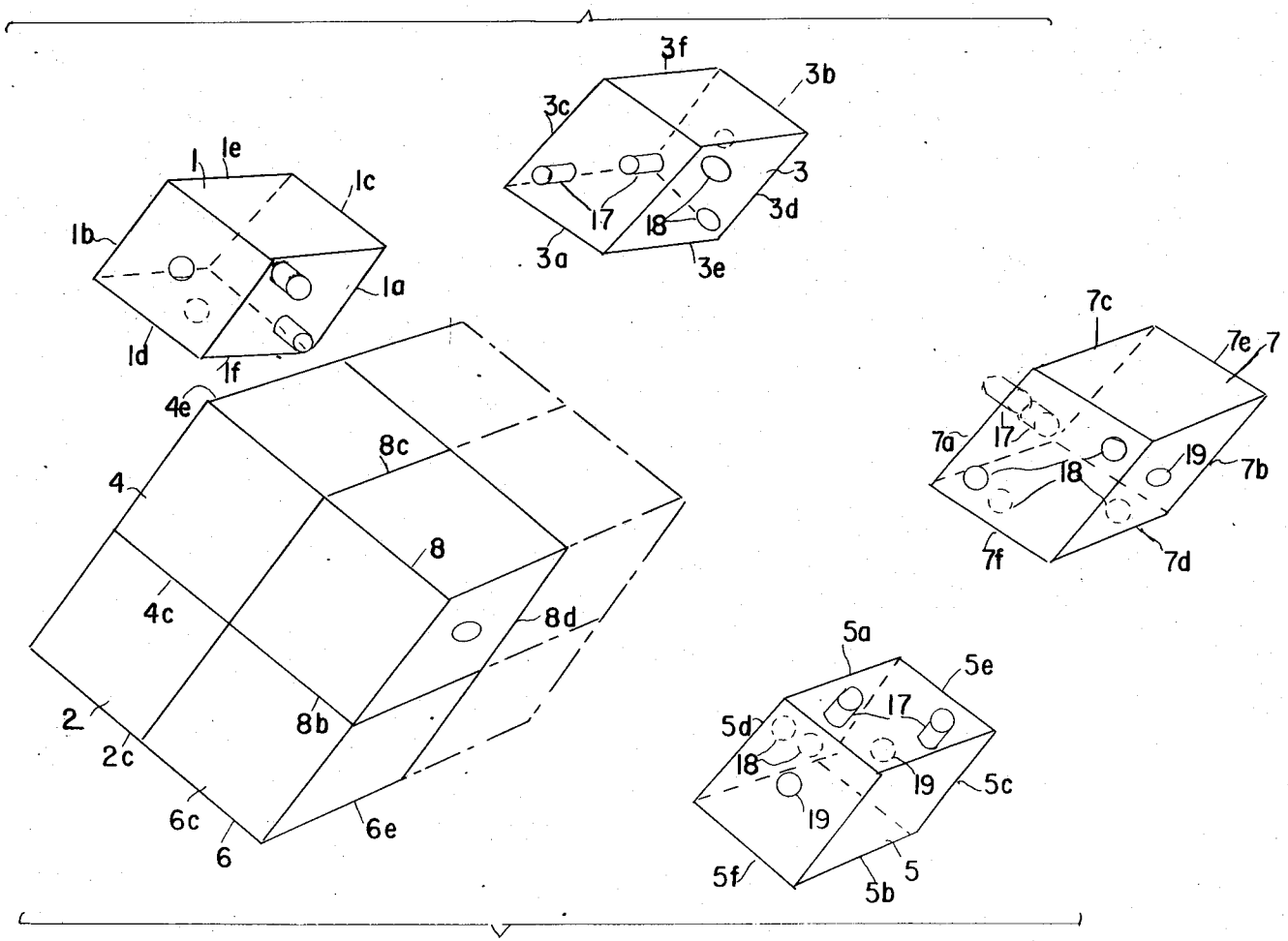
FIG. 14B is a partial, exploded, perspective view of the front half of the Puzzle body.

FIG. 14B shows a rear view of the puzzle with the back half (blocks 2, 4, 6 and 8) assembled and the front half (blocks 1, 3, 5, and 7) exploded. As FIG. 14A above, the blocks are translated from the body 9 while maintaining their respective solution orientations.

FIGS. 14A and 14B do not show the pegs 17 and holes 18 on the back of the assembled portions, it can be seen, however, that the pegs 17 on top face 8*a* of block 8 and the holes 18 on second side face 4*d* of block 4 are shown in FIG. 14A; and the pegs 17 on top face 3*a* of block 3 and the holes 18 on second end face 7*f* of block 7 are shown in FIG. 14B. In the solution orientation the holes 18 of block 14 receive the pegs 17 of block 3, and the holes 18 of block 7 on second end face 7*f* receive the pegs 17 of block 8.

The solution is illustrated using FIGS. 14A and 14B as follows:

In FIG. 14*b* the pegs 17 on top face 1*a* of block 1 are inserted into holes 18 on second side face 5*d* of block 5. The pegs 17 on top face 5*a* of block 5 are inserted into the holes 18 second side on face 7*d* of block 7. The pegs 17 on top face 7*a* of block 7 are inserted into the holes 18 on second side face 3*d* of block 3. In FIG. 14A the pegs 17 on top face 4*a* of block 4 are inserted into the holes 18 on second end face 2*f* of block 2. The pegs 17 on top face 2*a* of block 2 are inserted into the holes 18 on second end face 6*f* of block 6. The pegs 17 on top face 6*a* of block 6 are inserted into the holes 18 on second end face 8*f* of block 8. Finally, the pegs 17 on top face 3*a* of block 3, shown in FIG. 14A, are inserted into the holes 18 on second end face 4*f* of block 4 and the pegs 17 of block 8 are inserted into the holes 18 on second end face 7*f* of block 7, shown in FIG. 14B, simultaneously to form the completed puzzle body.

Leg dowels 16 with front feet 14 attached are inserted into apertures on second end face 1*f* of block 1 and bottom face 7*b* of block 7; and leg dowels 16 with back feet 15 attached are inserted into the apertures on first end face 2*e* of block 2 and second side face 8*d* of block 8. The mouth dowel is inserted into the aperture on first end face 5*e* of block 5; and the nose and eyes unit is inserted into the aperture on bottom face 3*b* of block 3.

Though the blocks are shown as cubes the invention contemplates the use of rectangular parallelepiped blocks to form a parallelepiped puzzle body.

While the invention has been particularly shown and described with reference to preferred embodiments thereof, it will be understood by those skilled in the art that various changes in form and detail may be made therein without departing from the spirit and scope of the invention as defined by the appended claims.

What is claimed is:

1. A set of at least eight parallelepipedic blocks adapted to be assembled into a parallelepiped, each of said blocks having a top face, a bottom face, first and second opposite side faces, and first and second opposite end faces, said set comprising:

(a) a first block having at least one peg on its top face, a planar bottom face, a planar first side face, a second side face with at least one aperture, a planar first end face, and a second end face having at least one aperture;

(b) a second block having at least one peg on its top face, a planar bottom face, planar first and second side faces, a first end face having at least one aperture, and a second end face having at least one hole;

(c) a third block having at least one peg on its top face, a bottom face having at least one aperture, a planar first side face, a second side face having at least one hole, and planar first and second end faces;

(d) a fourth block having at least one peg on its top face, a planar bottom face, a planar first side face, a second side face having at least one hole, a planar first end face, and a second end face having at least one aperture;

(e) a fifth block having at least one peg on its top face, a planar bottom face, a planar first side face, a second side face having at least one hole, a first end face having at least one aperture, and a second end face having at least one aperture;

(f) a sixth block having at least one peg on its top face, a planar bottom face, planar first and second side faces, a planar first end face, and a second end face having at least one hole;

(g) a seventh block having at least one peg on its top face, a bottom face having at least one aperture, a planar first side face, a second side face having at least one hole, a planar first end face, and a second end face having at least one hole;

(h) an eighth block having at least one peg on its top face, a planar bottom face, a planar first side face, a second side face having at least one aperture, a planar first end face, and a second end face having at least one hole.

2. A set in accordance with claim 1 further comprising four legs, a nose, and a mouth, each of said legs, said nose, and said mouth including a generally cylindrical dowel adapted to be inserted into said apertures.

3. A set in accordance with claim 2 wherein said first block top face comprises two spaced pegs, and wherein said first block second side face aperture and said first block second end face aperture each comprise means for frictionally receiving one of said dowels.

4. A set in accordance with claim 2 wherein said second block top face comprises two spaced pegs, said second block first end face aperture comprises means for frictionally receiving one of said dowels, and said second block second end face comprises two holes, each of said two holes comprising means for frictionally receiving one of said pegs of another block.

5. A set in accordance with claim 2 wherein said third block top face comprises two spaced pegs, said third block bottom face aperture comprises means for frictionally receiving one of said dowels, and said third block second side face comprises two holes, each of said two holes comprising means for frictionally receiving one of said pegs of another block.

6. A set in accordance with claim 2 wherein said fourth block top face comprises two spaced pegs, said fourth block second side face comprises two holes, each of said two holes comprising means for frictionally receiving one of said pegs of another block, and said fourth block second end face aperture comprises means for frictionally receiving one of said dowels.

7. A set in accordance with claim 2 wherein said fifth block top face comprises two spaced pegs, said fifth block second side face comprises two holes, each of said two holes comprising means for frictionally receiving one of said pegs of another block, said fifth block first and second end face apertures each comprise means for frictionally receiving one of said dowels.

8. A set in accordance with claim 2 wherein said sixth block top face comprises two spaced pegs, and said sixth block second end face comprises two holes, each of said two holes comprising means for frictionally receiving one of said pegs of another block.

9. A set in accordance with claim 2 wherein said seventh block top face comprises two spaced pegs, said seventh block bottom face aperture comprises means for frictionally receiving one of said dowels, said seventh block second side face comprises two holes, each of said two holes comprising means for frictionally receiving two of said pegs, and said second block second end face comprises two holes, each of said two holes comprising means for frictionally receiving one of said pegs of another block.

10. A set in accordance with claim 2 wherein said eighth block top face comprises two spaced pegs, said eighth block second side face aperture comprises means for frictionally receiving one of said dowels, and said eighth block second end face comprises two holes, each of said two holes comprising means for frictionally receiving one of said pegs of another block.

11. A set in accordance with claim 2 wherein each of said holes has a larger diameter than each of said apertures.

12. A set in accordance with claim 2 wherein each of the parallelepipedic blocks is cubic.

13. A method of assembling a parallelepiped from at least eight smaller parallelepipedic blocks, said method comprising:

(a) attaching a first block to a fifth block by inserting two pegs on a first face of said first block into holes on a first face of said fifth block;

(b) attaching said fifth block to a seventh by inserting two pegs on a second face of said fifth block into two holes on a first face of said seventh block;

(c) attaching said seventh block to a third block by inserting two pegs on a second face of said seventh block into two holes on a first face of said third block;

(d) attaching an eighth block to a sixth block by inserting two pegs on a first face of said sixth block into two holes on a first face of said eighth block;

(e) attaching said sixth block to a second block by inserting two pegs on a first face of said second block into two holes on a second face of said sixth block;

(f) attaching said second block to a fourth block by inserting two pegs on a first face of said fourth block into two holes on a second face of said second block;

(g) attaching said third block to said fourth block by inserting two pegs on a second face of said third block into two holes on a second face of said fourth block; and (h) attaching said seventh block to said eighth block by inserting two pegs on a second face of said eighth block into two holes on a third face of said seventh block.

14. A method in accordance with claim 13 further comprising attaching generally cylindrical dowels to apertures in said first, second, third, fifth, seventh, and eighth blocks by inserting a first leg dowel into an aperture in a second face of said first block, inserting a second leg dowel into an aperture on a third face of said second block, inserting a third leg dowel into an aperture on a fourth face of said seventh block, inserting a fourth leg dowel into an aperture on a third face of said eighth block, inserting a nose dowel into an aperture on a third face of said third block, and inserting a mouth dowel into an aperture on a third face of said fifth block.

15. A parallelepipedic puzzle formed from at least eight smaller parallelepipedic blocks, said puzzle comprising at least first, second, third, fourth, fifth, sixth, seventh, and eighth blocks, each block having first, second, third, fourth, fifth, and sixth faces wherein said first and fifth blocks, fifth and seventh blocks, seventh and third blocks, fourth and second blocks, second and sixth blocks, sixth and eighth blocks, third and fourth blocks, and seventh and eighth blocks, respectively, have faces which are directly connected to each other, all of the remaining faces being physically unattached to each other, each of said blocks including three exposed faces located on the exterior surface of said puzzle, wherein the three exposed faces of each of said fourth and said sixth blocks are flat and have no apertures, holes or pegs thereon.

16. A puzzle in accordance with claim 15 wherein said first and second blocks each have an exposed face with an aperture thereon; and said exposed face of said first and second blocks having apertures thereon are adjacent to each other on a first side face of said puzzle.

17. A puzzle in accordance with claim 16 wherein said seventh and eighth blocks each have an exposed face with an aperture thereon; and said exposed faces of said seventh and eighth blocks having apertures thereon are adjacent to each other on a second side face of said puzzle.

18. A puzzle in accordance with claim 17 wherein said third and fifth blocks each have an exposed face with an aperture thereon; and said exposed faces of said third and fifth blocks having apertures thereon are diagonally arranged on a third side of said puzzle.

19. A puzzle in accordance with claim 18 further comprising four legs, a nose, and a mouth, each of said legs, said nose, and said mouth, comprising a generally cylindrical dowel, said legs being inserted into said exposed apertures of said first, second, seventh, and eighth blocks, said mouth being inserted into said exposed aperture on said fifth block, and said nose being inserted into said exposed aperture on said third block, and said puzzle being generally diamond shaped in cross section when supported by said legs.

20. A puzzle in accordance with claim 19 further comprising means for directly connecting said first, second, third, fourth, fifth, sixth, seventh and eighth blocks comprising at least one peg on one face of each of the blocks and at least one hole for frictionally receiving said peg in at least one face of at least one of the other blocks, at least two of said blocks further comprising apertures on exterior faces thereof, each of said apertures comprising means for receiving at least one of said dowels.

21. A puzzle in accordance with claim 20 wherein said direct connecting means comprises two pegs on at least one face of each block and at least two holes, each comprising means for frictionally receiving the pegs, on one face of at least one other block.

22. A puzzle in accordance with claim 20 wherein the diameters of the holes are larger than the diameters of the apertures.

23. A puzzle in accordance with claim 15 wherein the parallelepipedic puzzle is a cubic puzzle formed from cubic blocks.

24. A puzzle in accordance with claim 15 wherein each block has a top face, bottom face, first and second opposed side faces, said first and second opposed end faces.

25. A puzzle in accordance with claim 20 wherein said first block top face comprises two spaced pegs, and wherein said first block second side face comprises an aperture, and said first block second end face comprises an aperture, wherein each of said apertures comprise means for frictionally receiving one of said dowels.

26. A puzzle in accordance with claim 20 wherein said second block top face comprises two spaced pegs, said second block first end face comprises an aperture which comprises means for frictionally receiving one of said dowels, and said second block second end face comprises two holes, each of said two holes comprising means for frictionally receiving two of said pegs of another block.

27. A puzzle in accordance with claim 20 wherein said third block top face comprises two spaced pegs, said third block bottom face comprises an aperture which comprises means for frictionally receiving one of said dowels, and said third block second side face comprises two holes, each of said two holes comprising means for frictionally receiving two of said pegs of another block.

28. A puzzle in accordance with claim 20 wherein said fourth block top face comprises two spaced pegs, and said fourth block second side face comprises two holes, each of said two holes comprising means for frictionally receiving two of said pegs of another block, said fourth block second end face comprises an aperture which comprises means for frictionally receiving one of said dowels.

29. A puzzle in accordance with claim 20 wherein said fifth block top face comprises two spaced pegs, and said fifth block second side face comprises two holes, each of said two holes comprising means for frictionally receiving two of said pegs of another block, said fifth block first and second end faces each comprise apertures which comprise means for frictionally receiving one of said dowels.

30. A puzzle in accordance with claim 15 wherein said sixth block top face comprises two spaced pegs, and said sixth block second end face comprises two holes, each of said two holes comprising means for frictionally receiving one of said pegs of another block.

31. A puzzle in accordance with claim 20 wherein said seventh block top face comprises two spaced pegs, said seventh block bottom face comprises an aperture which comprises means for frictionally receiving one of said dowels, said seventh block second side face comprises two holes, each of said two holes comprising means for frictionally receiving two of said pegs, and said second block second end face comprises two holes, each of said two holes comprising means for frictionally receiving two of said pegs of another block.

32. A puzzle in accordance with claim 20 wherein said eighth block top face comprises two spaced pegs; said eighth block second side face comprises an aperture which comprises means for frictionally receiving one of said dowels, and said eighth block second end face comprises two holes, each of said two holes comprising means for frictionally receiving two of said pegs of another block.

33. A parallelepipedic puzzle formed from at least eight smaller parallelepipedic blocks, said puzzle comprising at least first, second, third, fourth, fifth, sixth, seventh, and eighth blocks, each of said blocks having first, second, third fourth, fifth, and sixth faces wherein said first and fifth blocks, fifth and seventh blocks, third and seventh blocks, second and fourth blocks, second and sixth blocks, sixth and eighth blocks, third and fourth blocks, and seventh and eighth blocks, respectively, have faces which are directly connected to each other, all of the remaining faces of said blocks being physically unattached to each other, each of said blocks including three exposed faces on the exterior of said puzzle when said blocks are assembled, wherein at least two of said blocks have apertures on their exterior faces, each aperture comprising means for receiving simulated body parts in the form of dowels which are adapted to be inserted into said apertures, so that when said dowels are inserted into said apertures said assembled blocks will be positioned above a support surface on which said puzzle is positioned.

* * * * *

UNITED STATES PATENT AND TRADEMARK OFFICE

CERTIFICATE OF CORRECTION

PATENT NO. : 4,678,192

DATED : July 7, 1987

INVENTOR(S) : Bruce E. CAMPBELL

It is certified that error appears in the above-identified patent and that said Letters Patent is hereby corrected as shown below:

At column 2, line 65 change "parrallelepipedic" to ---parallelepipedic---.
At column 4, line 22 change "respectively" to ---respective---.
At column 4, line 37 change "frictionaly" to ---frictionally---.
At column 5, line 63 insert ---,--- after "3b".
At column 7, line 15 insert ---back--- after "block in the".
At column 12, line 38 insert ---, --- after "third".

Signed and Sealed this

Twelfth Day of July, 1988

*Attest:*

DONALD J. QUIGG

*Attesting Officer*

*Commissioner of Patents and Trademarks*